US011629018B2

(12) United States Patent
Chen et al.

(10) Patent No.: US 11,629,018 B2
(45) Date of Patent: Apr. 18, 2023

(54) FEEDING ROLLER STRUCTURE

(71) Applicant: Foxlink Image Technology Co., Ltd., New Taipei (TW)

(72) Inventors: Kuan Ting Chen, New Taipei (TW); Jing Hua Fang, New Taipei (TW); Pei Chun Lu, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 103 days.

(21) Appl. No.: 17/238,206

(22) Filed: Apr. 23, 2021

(65) Prior Publication Data

US 2021/0371221 A1 Dec. 2, 2021

(30) Foreign Application Priority Data

May 28, 2020 (CN) ..... 202020941181.9

(51) Int. Cl.
*B65H 3/06* (2006.01)

(52) U.S. Cl.
CPC ..... *B65H 3/0669* (2013.01); *B65H 3/0638* (2013.01); *B65H 2404/15212* (2013.01)

(58) Field of Classification Search
CPC ..... B65H 3/5284; B65H 3/42; B65H 3/5261; B65H 2404/15212
USPC ..... 271/117
See application file for complete search history.

(56) References Cited

U.S. PATENT DOCUMENTS 5,848,786 A * 12/1998 Holland-Letz ..... G07D 11/10 271/111
5,938,189 A * 8/1999 Holland-Letz ..... B65H 1/24 271/111
6,193,232 B1 * 2/2001 Regimbal ..... F16D 3/185 74/462
7,798,482 B2 * 9/2010 Koga ..... B41J 13/103 271/226
7,899,385 B2 * 3/2011 Koga ..... G03G 15/6567 399/388
8,360,414 B2 * 1/2013 Lo ..... B65H 3/0669 271/264
8,616,544 B2 * 12/2013 Katayama ..... B65H 7/02 271/109
8,746,677 B2 * 6/2014 Ramos ..... B41J 13/02 271/117
9,340,379 B2 * 5/2016 Kiuchi ..... B65H 3/0669
9,840,384 B2 * 12/2017 Sheng ..... B65H 3/063
(Continued)

*Primary Examiner* — Patrick Cicchino
(74) *Attorney, Agent, or Firm* — Lin & Associates Intellectual Property, Inc.

(57) ABSTRACT

A feeding roller structure includes a fastening frame, a transmission component, a transmission roller and a floating coupler. The transmission component is assembled in the fastening frame. The transmission component includes a drive shaft mounted on two sides of the fastening frame. The transmission roller is concentrically arranged around the drive shaft. The floating coupler is mounted to the fastening frame. The floating coupler is coupled between the drive shaft and the transmission roller. Two opposite ends of the floating coupler are adjacent to and spaced from the two sides of the fastening frame to form two gaps. Each gap is formed between one end of the floating coupler and one side of the fastening frame. The two gaps limit an angular displacement of the floating coupler.

13 Claims, 14 Drawing Sheets

(56) References Cited

U.S. PATENT DOCUMENTS

| | | | | |
|---|---|---|---|---|
| 2007/0160409 | A1* | 7/2007 | Koga | B41J 13/103 400/624 |
| 2009/0096152 | A1* | 4/2009 | Lo | B65H 3/0669 270/1.01 |
| 2011/0310156 | A1* | 12/2011 | Ramos | B41J 13/02 347/104 |

* cited by examiner

FEEDING ROLLER STRUCTURE

CROSS-REFERENCE TO RELATED APPLICATION

The present application is based on, and claims priority from, China Patent Application No. 202020941181.9, filed May 28, 2020, the disclosure of which is hereby incorporated by reference herein in its entirety.

BACKGROUND OF THE INVENTION

1. Field of the Invention

The present invention generally relates to a feeding roller structure, and more particularly to a feeding roller structure that is able to maintain a smooth contact with paper at the time of the paper failing to be fed horizontally.

2. The Related Art

Referring to FIG. 13 and FIG. 14, most pick-up roller and braking roller structures on ADF (Automatic Document Feeder) devices are designed with conventional fixation roller structures 100'. A hub 40' of the conventional fixation roller structure 100' is coaxially assembled to a drive shaft 20' to allow the hub 40' and the drive shaft 20' to only rotate around an axial direction, and other radial oscillations or angular displacements between the hub 40' and the drive shaft 20' are without being happened. Generally, the conventional fixation roller structure 100' is a feeding roller structure.

However, when paper is stacked in an input tray 51', the paper may fail to enter the conventional fixation roller structure 100' horizontally due to its own weight of the paper, so that the conventional fixation roller structure 100' is unable to maintain a smooth contact with the paper at the time of the paper failing to be fed horizontally. A positive force on one side of the paper is greater under the above-mentioned status, and feeding forces on both sides of the paper are uneven and the paper is caused to be skewed. Moreover, a life of a feeding roller 43' of the conventional fixation roller structure 100' is also shortened by a single-sided abrasion.

Therefore, it is especially important to provide a feeding roller structure that is able to maintain a smooth contact with the paper at the time of the paper failing to be fed horizontally.

SUMMARY OF THE INVENTION

An object of the present invention is to provide a feeding roller structure. The feeding roller structure includes a fastening frame, a transmission component, a transmission roller and a floating coupler. The transmission component is assembled in the fastening frame for transmitting power. The transmission component includes a drive shaft mounted on two sides of the fastening frame. The transmission roller is concentrically arranged around the drive shaft. The floating coupler is mounted to the fastening frame. The floating coupler is coupled between the drive shaft and the transmission roller. Two opposite ends of the floating coupler are adjacent to and spaced from the two sides of the fastening frame to form two gaps. Each gap is formed between one end of the floating coupler and one side of the fastening frame. The two gaps limit an angular displacement of the floating coupler.

Another object of the present invention is to provide a feeding roller structure. The feeding roller structure includes a fastening frame, a transmission component, a transmission roller and a floating coupler. Two sides of the fastening frame have a first side frame and a second side frame. The first side frame is opposite to the second side frame. The transmission component is assembled in the fastening frame for transmitting power. The transmission component includes a drive shaft mounted on the two sides of the fastening frame. The floating coupler is mounted to the fastening frame. The floating coupler is coupled between the drive shaft and the transmission roller. The floating coupler includes a floating shaft, and a hub concentrically covered on an outside of the floating shaft. Two gaps are provided at two opposite ends of the hub. One gap is formed between one end of the hub of the floating coupler and the first side frame, and the other gap is formed between the other end of the hub of the floating coupler and the second side frame. The hub is loosely cooperated with the floating shaft to compensate for an angular displacement between a rotation axis of the hub and a rotation axis of the floating shaft.

Another object of the present invention is to provide a feeding roller structure. The feeding roller structure includes a fastening frame, a drive shaft, a transmission roller and a floating coupler. The transmission roller is concentrically arranged around the drive shaft. The drive shaft is mounted on two sides of the fastening frame. The transmission roller is concentrically arranged around the drive shaft. The floating coupler is mounted to the fastening frame. The floating coupler is coupled between the drive shaft and the transmission roller. Two opposite ends of the floating coupler are adjacent to and spaced from the two sides of the fastening frame to form two gaps. The two gaps limit an angular displacement of the floating coupler. The floating coupler includes a floating shaft, and a hub concentrically covered on an outside of the floating shaft. The floating shaft has at least two outer transmission teeth disposed on an outer periphery surface of the floating shaft. The hub has at least two inner transmission teeth arranged on an inner periphery surface of the hub. When the floating shaft is assembled in the hub, the at least two inner transmission teeth are corresponding to and are engaged with the at least two outer transmission teeth. Profiles of the at least two outer transmission teeth of the outer periphery surface of the floating shaft are matched with profiles of the at least two inner transmission teeth of the inner periphery surface of the hub. An interstice is formed between the outer periphery surface of the floating shaft and the inner periphery surface of the hub so as to make a loose engagement between the floating shaft and the hub.

As described above, a pick-roller structure and a braking-roller structure both adopt designs of generating the angular displacement between the rotation axis of the hub and the rotation axis of the floating shaft, and the two gaps are formed among the two sides of the fastening frame and the hub to limit an angular displacement of the transmission roller, so that, at the time of the paper failing to be fed horizontally, the transmission roller maintains a smooth contact with a top surface of paper by compensating the angular displacement between the loosely engaged floating shaft and hub.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
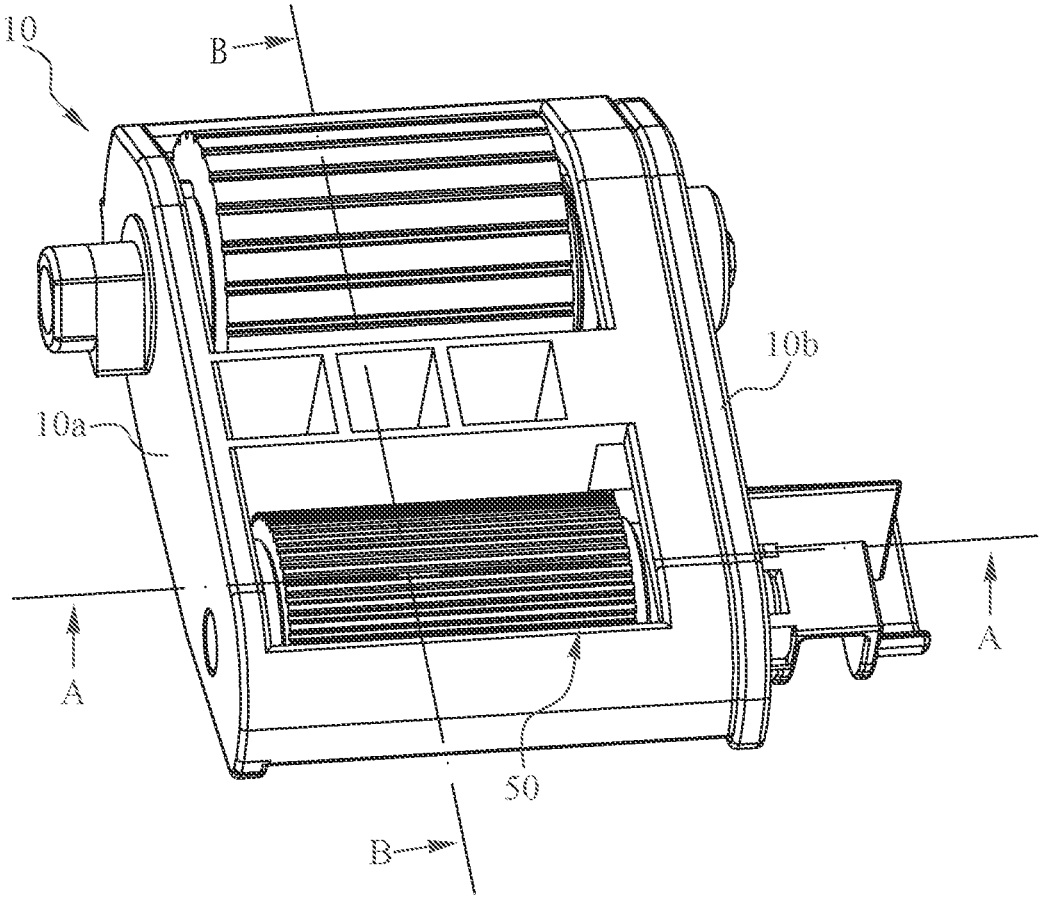
FIG. 1 shows a perspective view of a feeding roller structure in accordance with a first preferred embodiment of the present invention.
Figure 2:
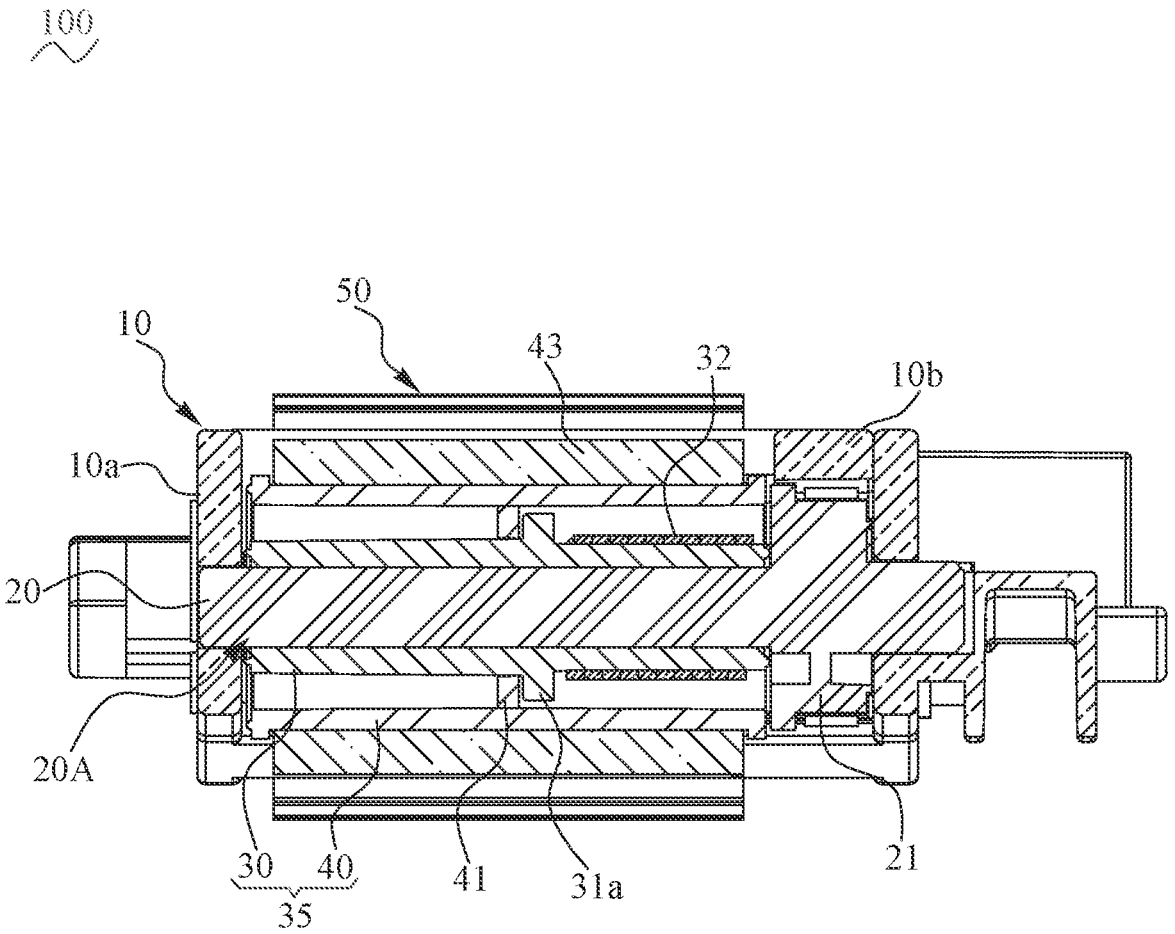
FIG. 2 shows a sectional view of the feeding roller structure along a line A-A of FIG. 1.

Referring to FIG. 1 and FIG. 2, a feeding roller structure 100 in accordance with a first preferred embodiment of the present invention is shown. The feeding roller structure 100 includes a fastening frame 10, a transmission component 20A assembled in the fastening frame 10 for transmitting power, a transmission roller 43 and a floating coupler 35 mounted to the fastening frame 10. The fastening frame 10 is substantially B-shaped. A front and a rear of the fastening frame 10 are opened freely and vertically penetrating through the fastening frame 10. The transmission component 20A includes a drive shaft 20 which is disposed parallel to a front and a rear of the fastening frame 10, and is mounted on two sides of the fastening frame 10. The transmission roller 43 is concentrically arranged around the drive shaft 20, and the floating coupler 35 is coupled between the drive shaft 20 and the transmission roller 43 for compensating a radial displacement and an angular displacement between the transmission roller 43 and paper. The floating coupler 35 is movable in radial or angular directions to compensate the radial displacement or the angular displacement between the transmission roller 43 and the paper. In particular, the angular displacement with an axial line is parallel to a paper-feeding direction.

Referring to FIG. 1 to FIG. 5, when the paper fails to be fed horizontally, compensate the radial displacement or the angular displacement between the transmission roller 43 and the paper through the floating coupler 35, so that the transmission roller 43 keeps contacting with the paper smoothly. In this first preferred embodiment, the transmission roller 43 is directly mounted around an outer periphery of the floating coupler 35. Two opposite ends of the floating coupler 35 are adjacent to and spaced from the two sides of the fastening frame 10 to form two gaps 42. Each gap 42 is formed between one end of the floating coupler 35 and one side of the fastening frame 10. The two gaps 42 limit the angular displacement of the floating coupler 35.

The two sides of the fastening frame 10 have a first side frame 10*a* and a second side frame 10*b* which are configured to secure two opposite ends of the drive shaft 20. The first side frame 10*a* is opposite to and is parallel to the second side frame 10*b*. The two opposite ends of the drive shaft 20 are mounted on the first side frame 10*a* and the second side frame 10*b*. A distance between the first side frame 10*a* and the second side frame 10*b* is predetermined, and the one end of the floating coupler 35 is adjacent to and spaced from the first side frame 10*a* to form one gap 42 between the one end of the floating coupler 35 and the first side frame 10*a* of the fastening frame 10, and the other end of the floating coupler 35 is adjacent to and spaced from the second side frame 10*b* to form the other gap 42 between the other end of the floating coupler 35 and the second side frame 10*b* to limit the angular displacement of the floating coupler 35. The two gaps 42 are formed among the two opposite ends of the floating coupler 35, the first side frame 10*a* and the second side frame 10*b*.

Figure 5:
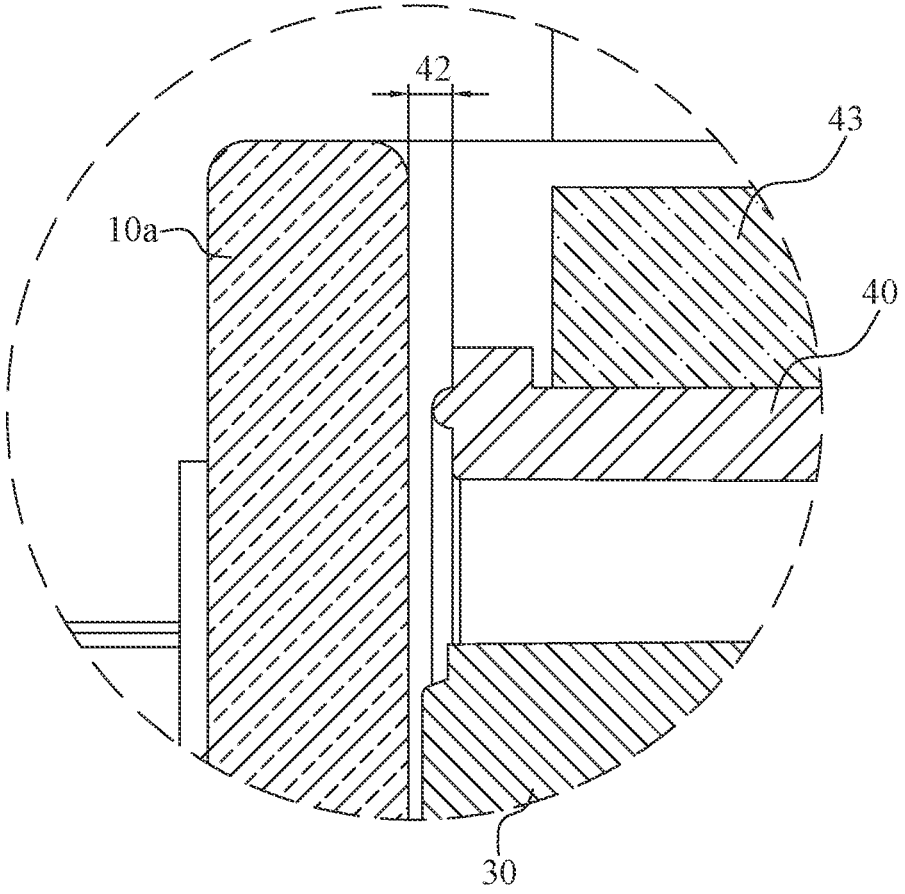
FIG. 5 is an enlarged diagram of a gap between a hub and a first side frame of the feeding roller structure in accordance with the present invention.
Figure 6:
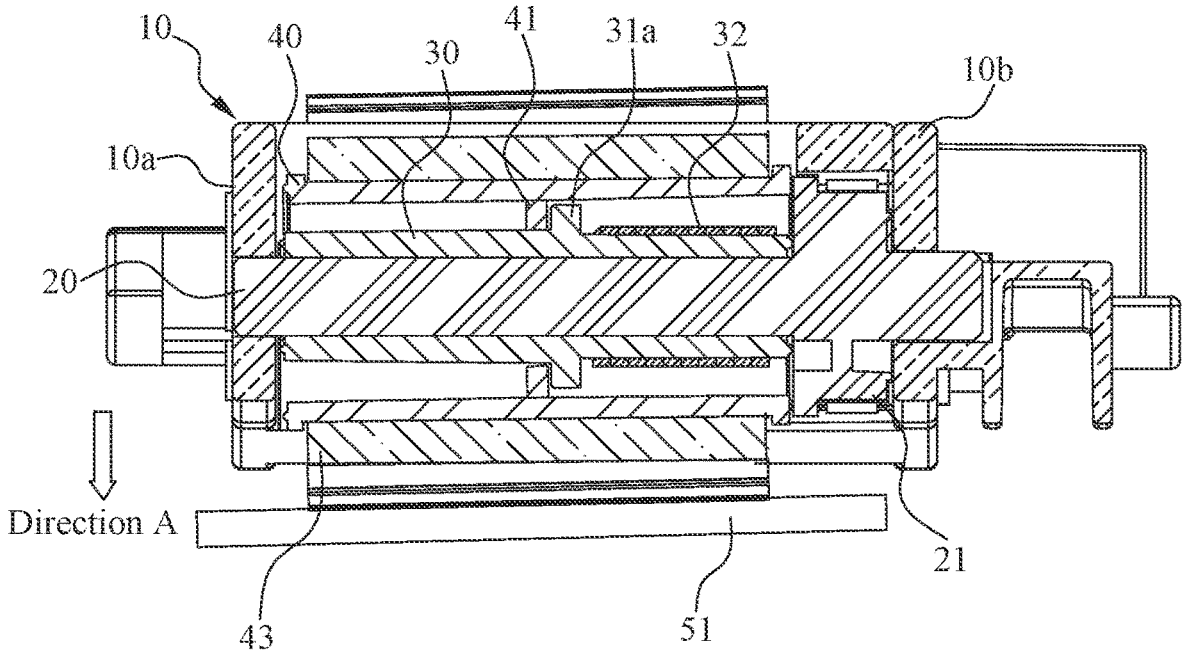
FIG. 6 shows a sectional view of the feeding roller structure assembled to a pick-up roller structure in accordance with the first preferred embodiment of the present invention.
Figure 7:
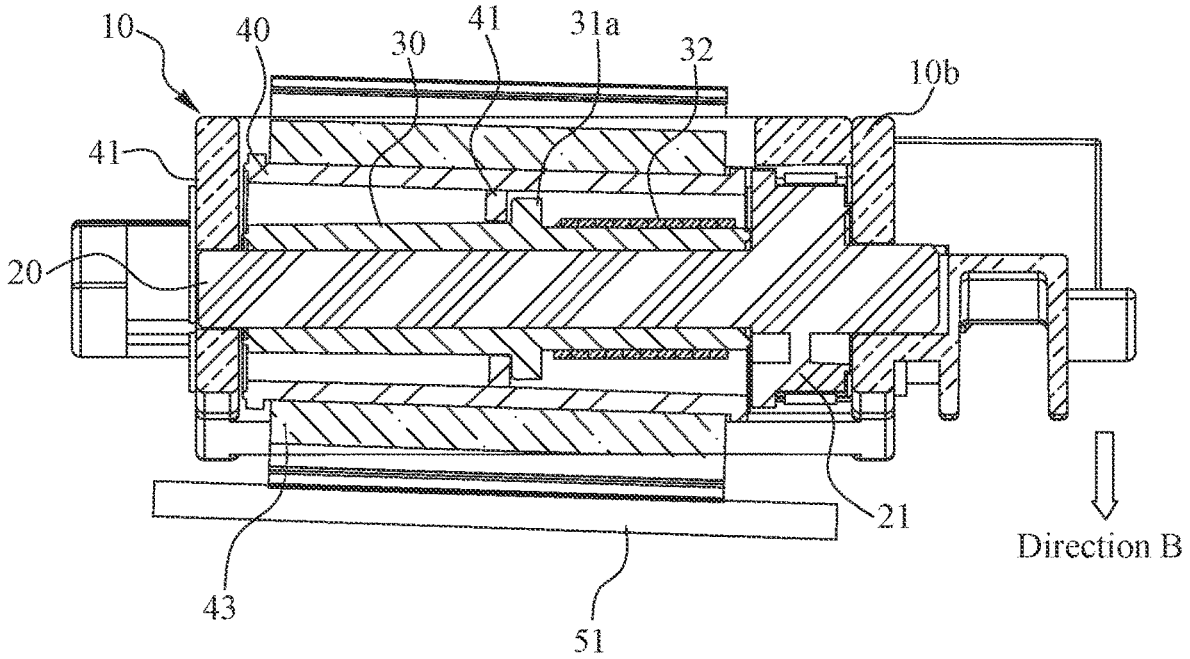
FIG. 7 shows another sectional view of the feeding roller structure assembled to the pick-up roller structure in accordance with a second preferred embodiment of the present invention.
Figure 8:
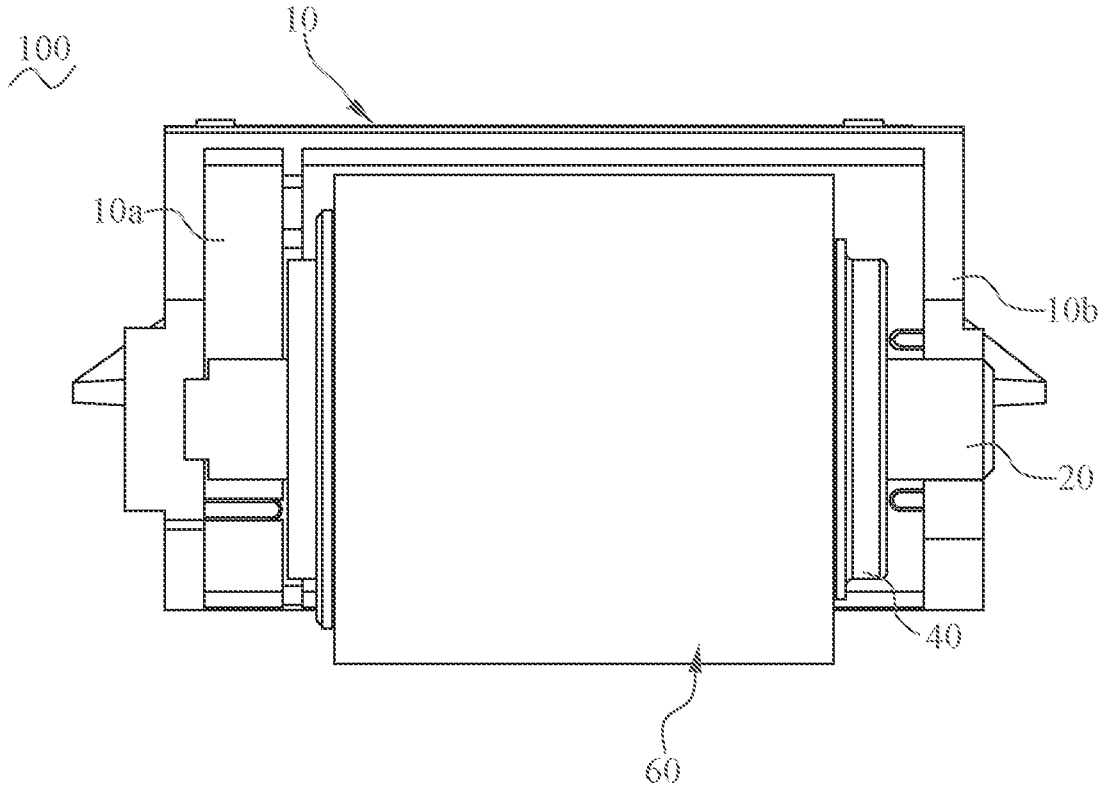
FIG. 8 shows a top view of the feeding roller structure in accordance with the second preferred embodiment of the present invention.

Referring to FIG. 1 to FIG. 7, the feeding roller structure 100 in accordance with a second preferred embodiment of the present invention is shown in FIG. 7. In the first preferred embodiment, the feeding roller structure 100 is applied to a pick-up roller structure 50 to make the pick-up roller structure 50 keep contacting with the inclined input tray 51 smoothly. In the first preferred embodiment and the second preferred embodiment, a process of compensating the radial displacement or the angular displacement between the transmission roller 43 and the paper loaded in an inclined input tray 51 of the feeding roller structure 100 is described below.

Figure 3:
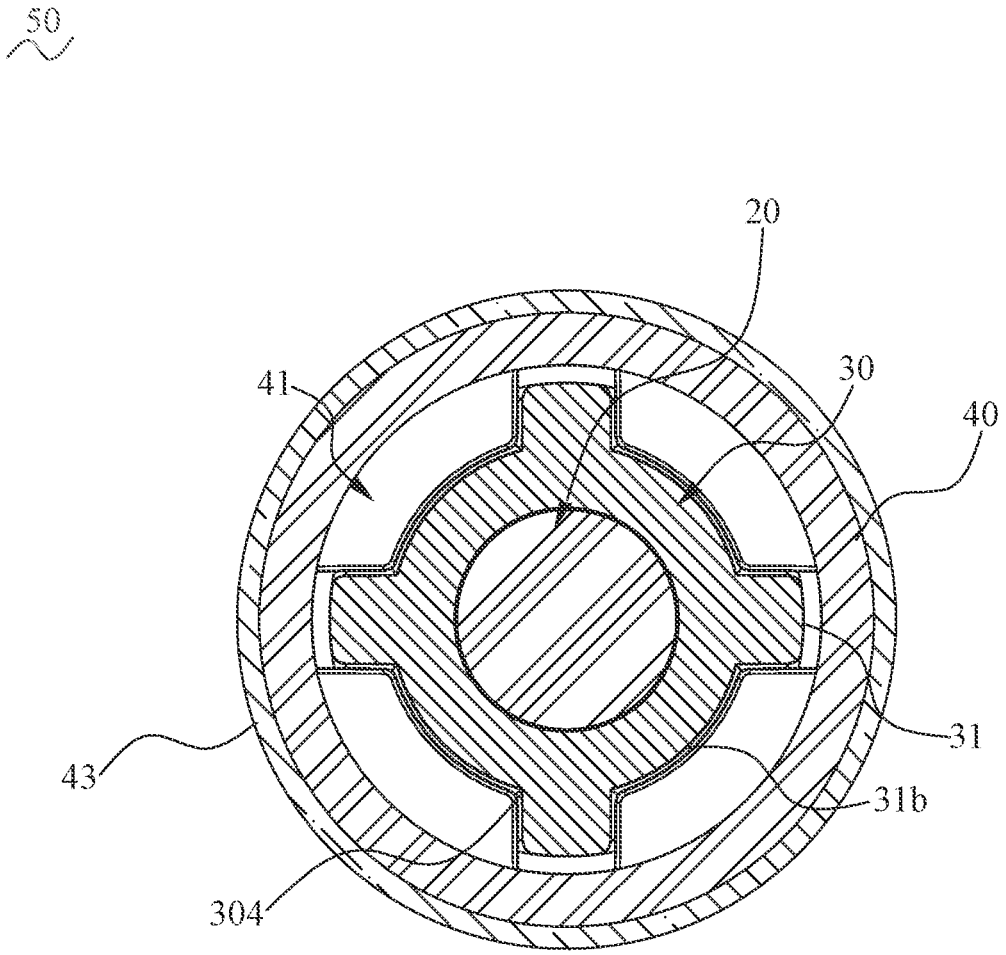
FIG. 3 shows another sectional view of the feeding roller structure alone a line B-B of FIG. 1.
Figure 4:
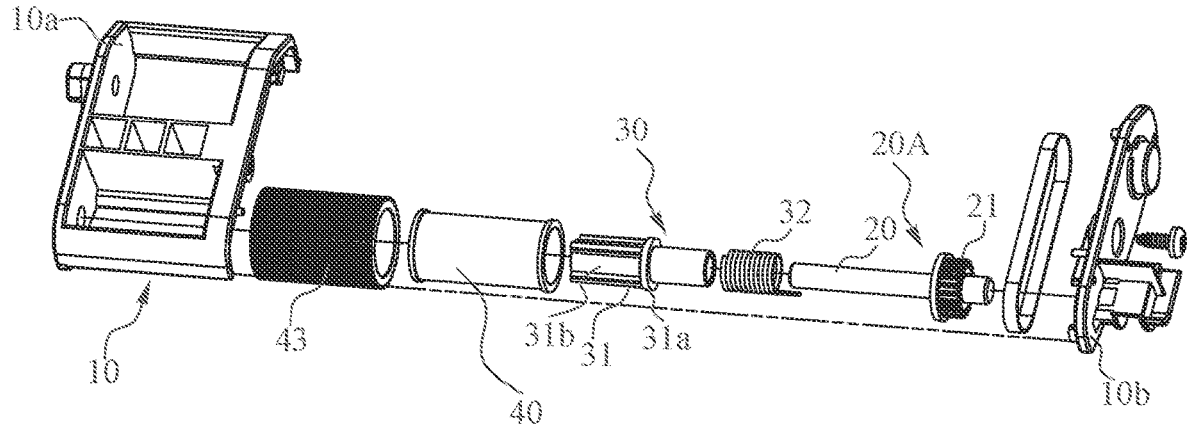
FIG. 4 shows an exploded view of the feeding roller structure in accordance with the present invention.

Referring to FIG. 2 to FIG. 4, the floating coupler 35 includes a floating shaft 30 and a hub 40. The floating shaft 30 has at least two outer transmission teeth 31 disposed on an outer periphery surface of the floating shaft 30, and a limit ring 31*a* concentrically arranged around the floating shaft 30. Specifically, the floating shaft 30 has four outer transmission teeth 31. The at least two outer transmission teeth 31 are symmetrically disposed on the outer periphery surface of the floating shaft 30 along an axial direction of the floating shaft 30. Each two adjacent outer transmission teeth 31 are spaced from each other to form a recess 31*b* between each two adjacent outer transmission teeth 31. The hub 40 is concentrically covered on an outside of the floating shaft 30. The hub 40 has at least two inner transmission teeth 41 arranged on an inner periphery surface of the hub 40. The at least two inner transmission teeth 41 are disposed in a center of the hub 40 and extend opposite to the limit ring 31*a*. Specifically, the hub 40 has four inner transmission teeth 41. When the floating shaft 30 is assembled in the hub 40, the at least two inner transmission teeth 41 are corresponding to and are engaged with the at least two outer transmission teeth 31. Specifically, when the floating shaft 30 is assembled in the hub 40, the four inner transmission teeth 41 are corresponding to and are engaged with the four outer transmission teeth 31. The hub 40 is loosely cooperated with the floating shaft 30 to compensate for an angular displacement between a rotation axis of the hub 40 and a rotation axis of the floating shaft 30. Profiles of the at least two outer transmission teeth 31 of the outer periphery surface of the floating shaft 30 are matched with profiles of the at least two inner transmission teeth 41 of the inner periphery surface of the hub 40. An interstice 304 is formed between the outer periphery surface of the floating shaft 30 and the inner periphery surface of the hub 40 so as to make a loose engagement between the floating shaft 30 and the hub 40.

Referring to FIG. 2 and FIG. 4, when the feeding roller structure 100 is applied to the pick-up roller structure 50 in accordance with the second preferred embodiment, the second side frame 10*b* is detachably assembled on one side of the fastening frame 10. The transmission component 20A includes a transmission gear 21 positioned at one end of the drive shaft 20, and a torsion spring 32 mounted around the drive shaft 20 and arranged adjacent to the transmission gear 21. The torsion spring 32 is concentrically sleeved around one end of the outer periphery surface of the floating shaft 30 and drives the floating shaft 30. The at least two outer transmission teeth 31 are disposed on the other end of the outer periphery surface of the floating shaft 30. The transmission gear 21 is concentrically arranged to and is adjacent to the one end of the outer periphery surface of the floating shaft 30 for driving the floating shaft 30. The torsion spring 32 and the at least two outer transmission teeth 31 are positioned on two opposite ends of the outer periphery surface of the floating shaft 30. The limit ring 31*a* is disposed between the torsion spring 21 and the at least two outer transmission teeth 31, and is closer to the torsion spring 32. The hub 40 is driven by the floating shaft 30 by virtue of the torsion spring 32 driving the floating shaft 30.

Referring to FIG. 2 and FIG. 5, in order to further limit the maximum angular displacement of the pick-roller structure 50, the two gaps 42 are provided at two opposite ends of the hub 40. The distance between the first side frame 10*a* and the second side frame 10*b* is predetermined, and the one gap 42 is formed between one end of the hub 40 of the floating coupler 35 and the first side frame 10*a*, and the other gap 42 is formed between the other end of the hub 40 of the floating coupler 35 and the second side frame 10*b*, namely, the one gap 42 is formed between a left end of the hub 40 of the floating coupler 35 and the first side frame 10*a*, and the other gap 42 is formed between a right end of the hub 40 of the floating coupler 35 and the second side frame 10*b*. The maximum angular displacement between the rotation axis of the hub 40 and the rotation axis of the floating shaft 30 is limited to 2.75 degrees by limitations of the two gaps 42.

Referring to FIG. 6 and FIG. 7, when the input tray 51 is inclined towards a direction (A) shown in FIG. 6 due to a weight of the paper, the hub 40 tilts to compensate the angular displacement between the transmission roller 43 and the paper, the hub 40 will be cooperated with the input tray 51 to generate one angular displacement between the hub 40 and the floating shaft 30 to make the hub 40 synchronously inclined towards the direction (A), so that the transmission roller 43 keeps contacting with the paper smoothly. In a similar way, when the input tray 51 is inclined towards a direction (B) shown in FIG. 7, the hub 40 tilts to compensate the angular displacement between the transmission roller 43 and the paper, the hub 40 will be cooperated with the input tray 51 to generate another angular displacement between the hub 40 and the floating shaft 30 to make the hub 40 synchronously inclined towards the direction (B), so that the transmission roller 43 keeps contacting with the paper smoothly.

Referring to FIG. 7 to FIG. 12, in the second preferred embodiment, the feeding roller structure 100 is applied to a braking-roller structure 60 of a separation roller module (not shown), so that the braking-roller structure 60 keeps contacting with the paper smoothly, and a process of compensating a radial displacement or an angular displacement between the braking-roller structure 60 and the paper is described below.

Referring to FIG. 9 to FIG. 12, in the second preferred embodiment, the floating coupler 35 includes the floating shaft 30 and the hub 40. The floating shaft 30 has the at least two outer transmission teeth 31 disposed on the one end of the outer periphery surface of the floating shaft 30, and the limit ring 31*a*. The limit ring 31*a* is concentrically arranged around the other end of the outer periphery surface of the floating shaft 30. Specifically, the floating shaft 30 has two outer transmission teeth 31. The at least two outer transmission teeth 31 are symmetrically disposed on the outer periphery surface of the floating shaft 30 along the axial direction of the floating shaft 30. The limit ring 31*a* has two buckling slots 31*c* recessed inward and towards an inside of the floating shaft 30. The two buckling slots 31*c* are symmetrically arranged along the axial direction of the floating shaft 30.

The hub 40 is concentrically covered on the outside of the floating shaft 30. The hub 40 has the at least two inner transmission teeth 41 disposed on the inner periphery surface of the hub 40. Specifically, the hub 40 has two inner transmission teeth 41. When the floating shaft 30 is assembled in the hub 40, the at least two inner transmission teeth 41 are corresponding to and are engaged with the at least two outer transmission teeth 31. In this second preferred embodiment, because a larger positive force is exerted on the braking-roller structure 60, at least two portions of the inner periphery surface of the hub 40 extend towards opposite directions and opposite to the limit ring 31*a* to form the at least two inner transmission teeth 41 for reinforcing the hub 40, and middles of facing surfaces of the at least two inner transmission teeth 41 are arched oppositely and away from the floating shaft 30. The hub 40 is prevented from being deformed by an action of the positive force.

Figure 9:
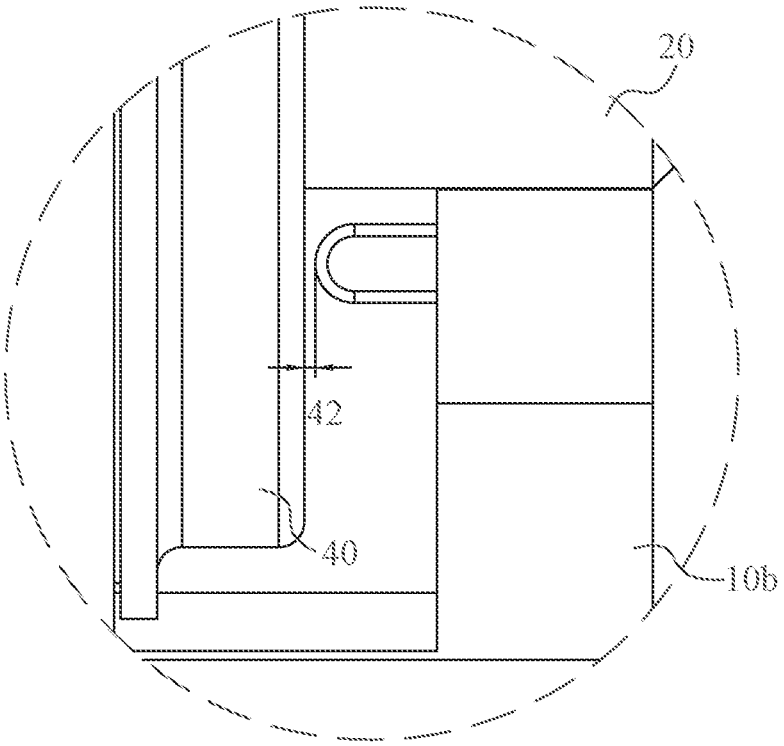
FIG. 9 is an enlarged diagram of a gap between the hub and a fourth side frame of the feeding roller structure in accordance with the present invention.
Figure 10:
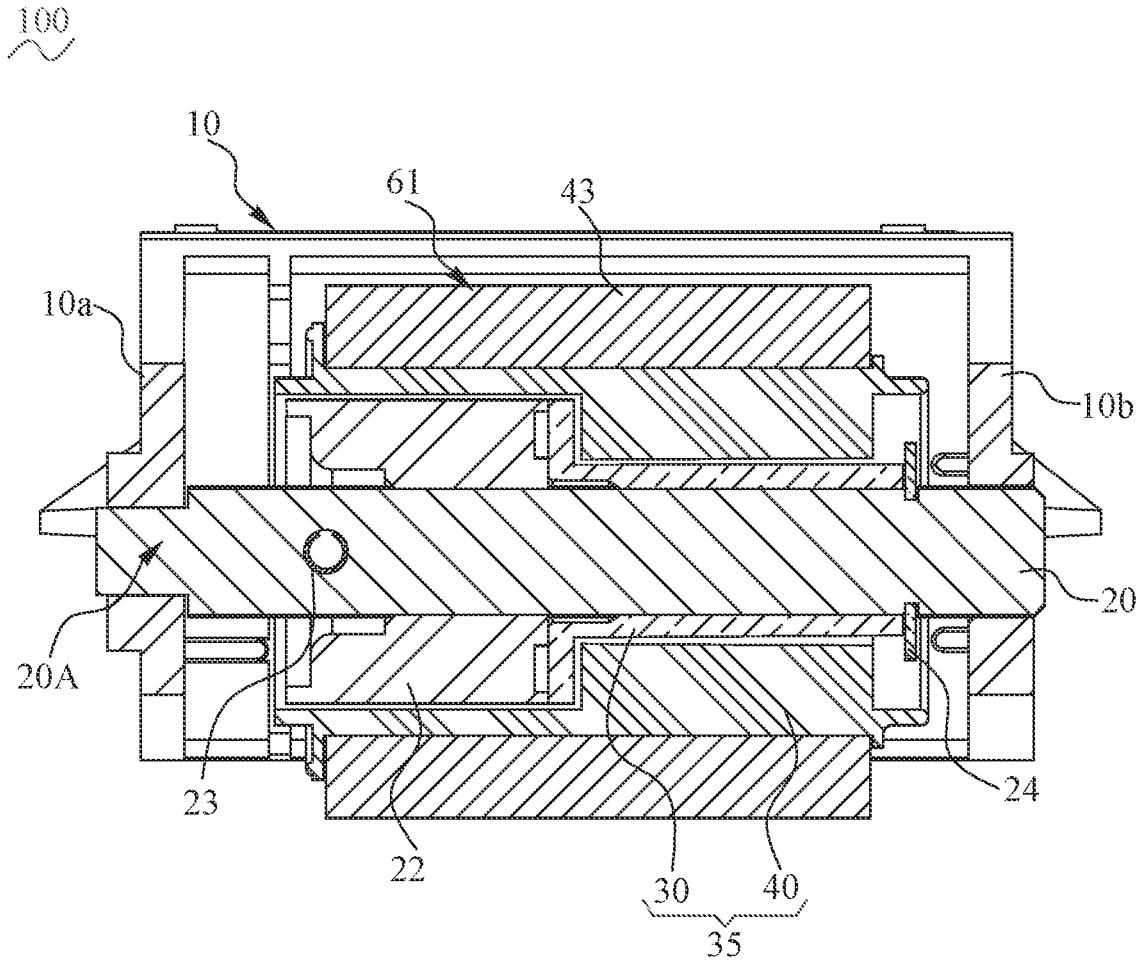
FIG. 10 shows a sectional view of the feeding roller structure assembled in a braking-roller structure of the feeding roller structure in accordance with the present invention.
Figure 11:
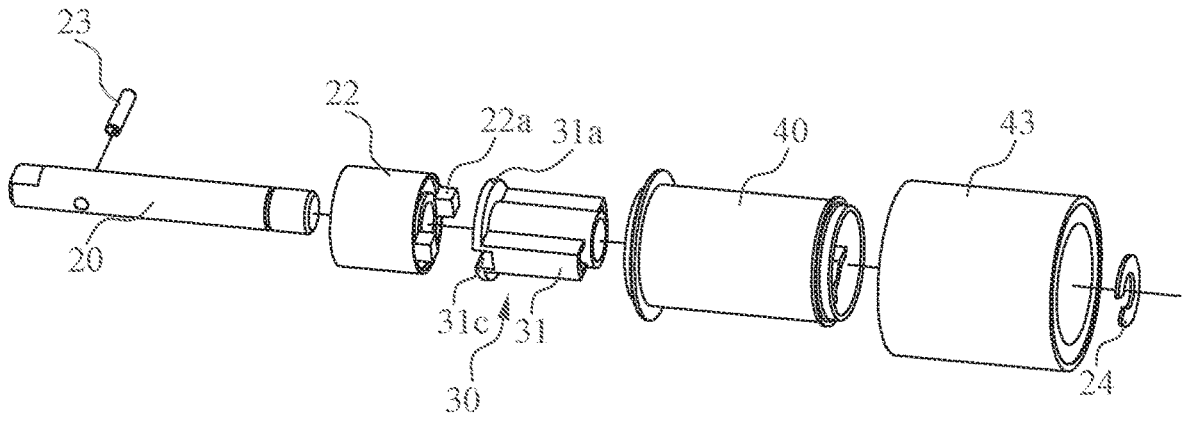
FIG. 11 shows an exploded view of a transmission roller assembled in the braking-roller structure of the feeding roller structure in accordance with the present invention.
Figure 12:
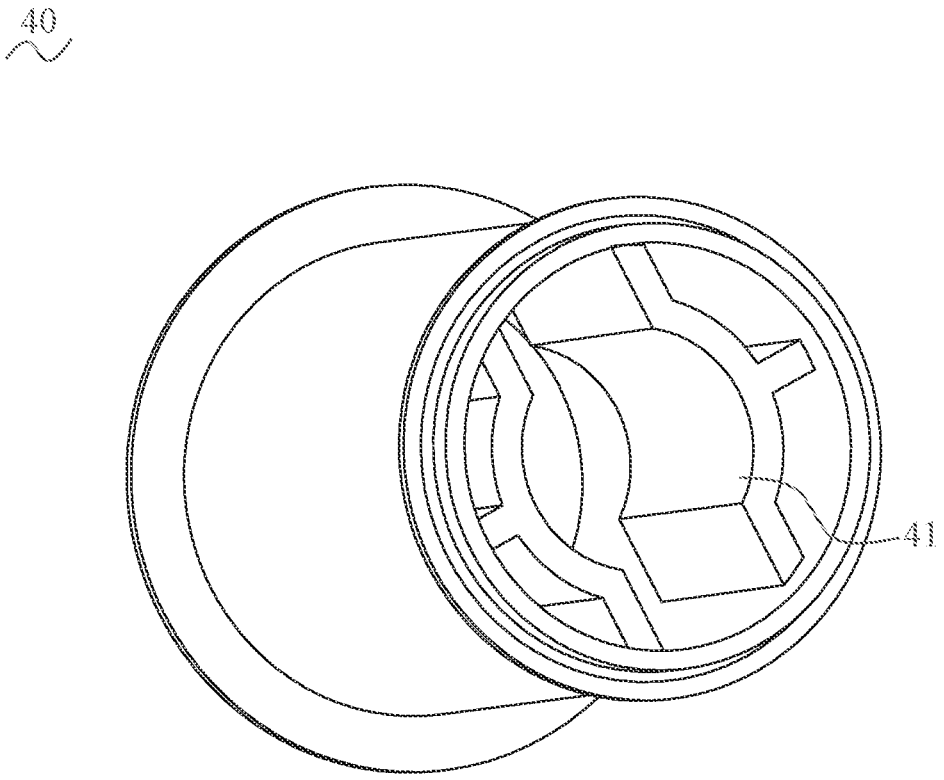
FIG. 12 shows a perspective view of the hub of the feeding roller structure in accordance with the present invention.
Figure 13:
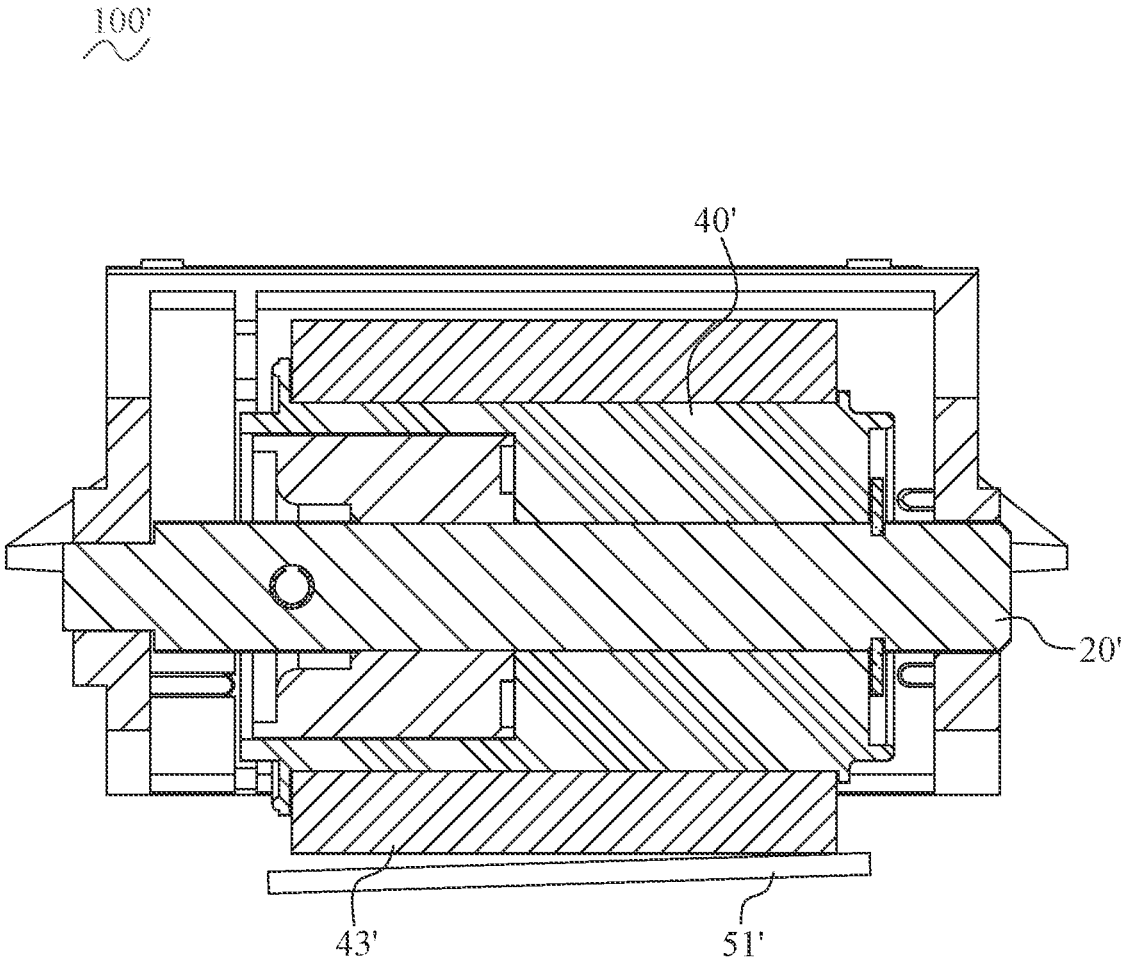
FIG. 13 (Prior Art)
FIG. 13 shows a sectional view of a conventional fixation roller structure in prior art.
Figure 14:
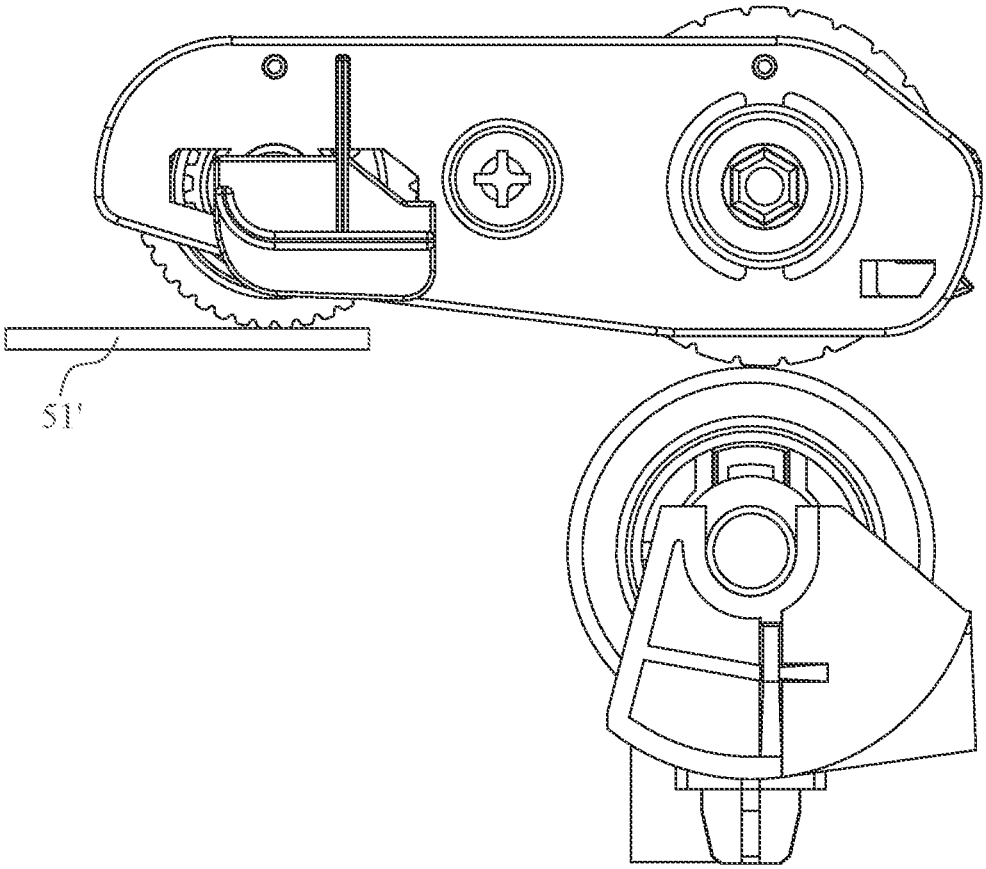
FIG. 14 (Prior Art)
FIG. 14 is a partially schematic diagram of an automatic document feeder including the conventional fixation roller structure in the prior art.

Referring to FIG. 9 to FIG. 12 again, in the second preferred embodiment, the transmission component 20A includes a torque limiter 22 connected to the other end of the drive shaft 20 and matched with one end of the floating shaft 30. The toque limiter 22 is engaged with the one end of the floating shaft 30. The torque limiter 22 is connected between the other end of the drive shaft 20 and the one end of the floating shaft 30. The torque limiter 22 has two buckling elements 22*a* protruded towards the floating shaft 30. Two sides of the one end of the floating shaft 30 are recessed inward and away from the torque limiter 22 to form the two buckling slots 30*c* corresponding to the two buckling elements 22*a*. The two buckling elements 22*a* are axially and symmetrically arranged at one end of the torque limiter 22 proximate to the floating shaft 30, and the two buckling elements 22*a* are matched with and are engaged with the two buckling slots 30*c* for transmitting a driving torque to the hub 40 through the torque limiter 22 and the floating shaft 30. The limit ring 31*a* contacts with one end of the torque limiter 22 adjacent to the limit ring 31*a*. The floating shaft 30 drives the hub 40 by means of the torque limiter 22 driving the floating shaft 30.

In order to avoid generating an axial displacement between the torque limiter 22 and the floating shaft 30 at the time of transmitting power, the transmission component 20A includes a fastening pin 23 penetrating through the drive shaft 20 longitudinally and close to the other end of the torque limiter 22. The transmission component 20A further includes a fixing plate 24 arranged at the one end of the torque limiter 22 opposite to the fixing pin 23. The fixing plate 24 is disposed to and fixed to the one end of the drive shaft 20 to secure the torque limiter 22 and the floating shaft 30 to the drive shaft 20, so that the torque limiter 22 and the floating shaft 30 are fastened to the drive shaft 20, namely the drive shaft 20 is fastened in the torque limiter 22 and the floating shaft 30.

Referring to FIG. 8 to FIG. 12, similarly, when the paper is fed into the separation roller module, in order to limit the maximum angular displacement of the braking-roller structure 60, the two gaps 42 are provided at the two opposite ends of the hub 40. The distance between the first side frame 10*a* and the second side frame 10*b* is predetermined, so the one gap 42 is formed between the left end of the hub 40 and the first side frame 10*a*, and the other gap 42 is formed between the right end of the hub 40 and the second side frame 10*b*. The maximum angular displacement between the rotation axis of the hub 40 and the rotation axis of the floating shaft 30 is limited to 2.75 degrees by the limitations of the two gaps 42.

As described above, the pick-roller structure 50 and the braking-roller structure 60 both adopt designs of generating the angular displacement between the rotation axis of the hub 40 and the rotation axis of the floating shaft 30, and the two gaps 42 are formed among the two sides of the fastening frame 10 and the hub 40 to limit the angular displacement of the transmission roller 43, so that, at the time of the paper failing to be fed horizontally, the transmission roller 43 maintains a smooth contact with a top surface of the paper by compensating the angular displacement between the loosely engaged floating shaft 30 and hub 40.

What is claimed is:

1. A feeding roller structure, comprising:

a fastening frame;

a transmission component assembled in the fastening frame for transmitting power, the transmission component including a drive shaft mounted on two sides of the fastening frame;

a transmission roller concentrically arranged around the drive shaft; and a floating coupler mounted to the fastening frame, the floating coupler being coupled between the drive shaft and the transmission roller, two opposite ends of the floating coupler being adjacent to and spaced from the two sides of the fastening frame to form two gaps, each gap being formed between one end of the floating coupler and one side of the fastening frame, the two gaps limiting an angular displacement of the floating coupler;

wherein the floating coupler includes a floating shaft, and a hub concentrically covered on an outside of the floating shaft, the floating shaft has at least two outer transmission teeth disposed on an outer periphery surface of the floating shaft, and a limit ring concentrically arranged around the floating shaft, the at least two outer transmission teeth are symmetrically disposed on the outer periphery surface of the floating shaft along an axial direction of the floating shaft, the hub has at least two inner transmission teeth arranged on an inner periphery surface of the hub, when the floating shaft is assembled in the hub, the at least two inner transmission teeth are corresponding to and are engaged with the at least two outer transmission teeth, the hub is loosely cooperated with the floating shaft to compensate for an angular displacement between a rotation axis of the hub and a rotation axis of the floating shaft.

2. The feeding roller structure as claimed in claim 1, wherein the floating shaft has four outer transmission teeth, the hub has four inner transmission teeth, when the floating shaft is assembled in the hub, the four inner transmission teeth are corresponding to and are engaged with the four outer transmission teeth.

3. The feeding roller structure as claimed in claim 1, wherein each two adjacent outer transmission teeth are spaced from each other to form a recess between each two adjacent outer transmission teeth.

4. The feeding roller structure as claimed in claim 1, wherein the two sides of the fastening frame have a first side frame and a second side frame which are configured to secure two opposite ends of the drive shaft, the first side frame is parallel to the second side frame, the two opposite ends of the drive shaft are mounted on the first side frame and the second side frame.

5. The feeding roller structure as claimed in claim 4, wherein the one end of the floating coupler is adjacent to and spaced from the first side frame to form one gap between the one end of the floating coupler and the first side frame of the fastening frame, and the other end of the floating coupler is adjacent to and spaced from the second side frame to form the other gap between the other end of the floating coupler and the second side frame.

6. The feeding roller structure as claimed in claim 5, wherein the maximum angular displacement between a rotation axis of the hub and a rotation axis of the floating shaft of the floating coupler is limited to 2.75 degrees by limitations of the two gaps.

7. The feeding roller structure as claimed in claim 1, wherein the transmission component includes a transmission gear positioned at one end of the drive shaft, and a torsion spring mounted around the drive shaft and arranged adjacent to the transmission gear.

8. The feeding roller structure as claimed in claim 7, wherein the torsion spring is concentrically sleeved around one end of an outer periphery surface of the floating shaft and drives the floating shaft, the torsion spring and the at least two outer transmission teeth are positioned on two opposite ends of the outer periphery surface of the floating shaft, the limit ring is disposed between the torsion spring and the at least two outer transmission teeth, and is closer to the torsion spring.

9. The feeding roller structure as claimed in claim 8, wherein the transmission component includes a torque limiter connected to the other end of the drive shaft and matched with one end of the floating shaft, the toque limiter is engaged with the one end of the floating shaft.

10. The feeding roller structure as claimed in claim 9, wherein the torque limiter has two buckling elements protruded towards the floating shaft, two sides of the one end of the floating shaft are recessed inward and away from the torque limiter to form two buckling slots corresponding to the two buckling elements, the two buckling elements are axially and symmetrically arranged at one end of the torque limiter proximate to the floating shaft, and the two buckling elements are matched with and are engaged with the two buckling slots.

11. The feeding roller structure as claimed in claim 10, wherein the limit ring is concentrically arranged around the other end of the outer periphery surface of the floating shaft, the limit ring contacts with one end of the torque limiter adjacent to the limit ring, the limit ring has two buckling slots recessed inward and towards an inside of the floating shaft, the two buckling slots are symmetrically arranged along an axial direction of the floating shaft, the at least two inner transmission teeth are disposed in a center of the hub and extend opposite to the limit ring.

12. A feeding roller structure, comprising:

a fastening frame, two sides of the fastening frame having a first side frame and a second side frame, the first side frame being opposite to the second side frame;

a transmission component assembled in the fastening frame for transmitting power, the transmission component including a drive shaft mounted on the two sides of the fastening frame;

a transmission roller concentrically arranged around the drive shaft; and a floating coupler mounted to the fastening frame, the floating coupler being coupled between the drive shaft and the transmission roller, the floating coupler including a floating shaft, and a hub concentrically covered on an outside of the floating shaft, two gaps being provided at two opposite ends of the hub, one gap being formed between one end of the hub of the floating coupler and the first side frame, and the other gap being formed between the other end of the hub of the floating coupler and the second side frame, the hub being loosely cooperated with the floating shaft to compensate for an angular displacement between a rotation axis of the hub and a rotation axis of the floating shaft.

13. A feeding roller structure, comprising:

a fastening frame;

a drive shaft mounted on two sides of the fastening frame;

a transmission roller concentrically arranged around the drive shaft; and a floating coupler mounted to the fastening frame, the floating coupler being coupled between the drive shaft and the transmission roller, two opposite ends of the floating coupler being adjacent to and spaced from the two sides of the fastening frame to form two gaps, the two gaps limiting an angular displacement of the floating coupler, the floating coupler including a floating shaft, and a hub concentrically covered on an outside of the floating shaft, the floating shaft having at least two outer transmission teeth disposed on an outer periphery surface of the floating shaft, the hub having at least two inner transmission teeth arranged on an inner periphery surface of the hub, when the floating shaft is assembled in the hub, the at least two inner transmission teeth being corresponding to and being engaged with the at least two outer transmission teeth, profiles of the at least two outer transmission teeth of the outer periphery surface of the floating shaft being matched with profiles of the at least two inner transmission teeth of the inner periphery surface of the hub, an interstice being formed between the outer periphery surface of the floating shaft and the inner periphery surface of the hub so as to make a loose engagement between the floating shaft and the hub.

* * * * *